US009636595B2

(12) United States Patent
Shen et al.

(10) Patent No.: US 9,636,595 B2
(45) Date of Patent: May 2, 2017

(54) TOY FIGURES WITH EXPANDABLE ARTICULATING JOINTS

(71) Applicant: Mattel, Inc., El Segundo, CA (US)

(72) Inventors: Leo Shen, Shen Zhen (CN); Toby Zeng, Shen Zhen (CN); Kar Wah Wong, Hong Kong (CN); Josiah T. S. Li, Monterey Park, CA (US); Matthew D. Press, Culver City, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/866,665

(22) Filed: Sep. 25, 2015

(65) Prior Publication Data

US 2017/0087477 A1 Mar. 30, 2017

(51) Int. Cl.
*A63H 3/46* (2006.01)

(52) U.S. Cl.
CPC ..... *A63H 3/46* (2013.01)

(58) Field of Classification Search
USPC ..... 446/320, 321, 330, 333, 334, 336, 337, 446/338, 340, 370, 371, 373, 375, 376, 446/390, 391
See application file for complete search history.

(56) References Cited

U.S. PATENT DOCUMENTS 1,359,030 A 11/1920 Cabana
2,623,329 A * 12/1952 Di Leva ..... A63H 3/48 446/320
2,632,586 A * 3/1953 Barrango ..... A47F 8/00 223/68
3,375,604 A 4/1968 Alonso
3,469,339 A 9/1969 Thomas
3,693,292 A 9/1972 Di Leva
3,862,513 A * 1/1975 Isaacson ..... A63H 3/20 273/108.22
3,940,880 A 3/1976 Kaelin et al.
3,986,295 A * 10/1976 Keller ..... A63H 13/06 446/320
3,995,394 A * 12/1976 Ayton ..... A63H 3/48 446/320
4,274,224 A 6/1981 Pugh et al.
4,411,097 A * 10/1983 Murakami ..... A63H 3/16 446/376

(Continued)

FOREIGN PATENT DOCUMENTS

WO 2007008172 A1 1/2007

*Primary Examiner* — Kurt Fernstrom
(74) *Attorney, Agent, or Firm* — Sheppard, Mullin, Richter & Hampton LLP

(57) ABSTRACT

An articulating toy figure having a body and one or more body segments coupled to the body. The one or more body segments are each independently and translationally movable between a first position proximal to the body and a second position distal to the body. One or more detents are provided to secure the position of the one or more body segments in one of the first and second positions. The one or more body segments are each movable between the first and second position by applying a force on the one or more body segments that overcomes the biasing force of the one or more detents. The one or more body segments may be selected from the group consisting of a head, an arm, a leg, and a tail.

17 Claims, 9 Drawing Sheets

(56) References Cited

U.S. PATENT DOCUMENTS 4,526,552 A * 7/1985 Rhodes ..... A63H 3/48 446/320
4,530,671 A * 7/1985 Mednick ..... A63H 3/48 446/320
4,622,021 A * 11/1986 Darrigo, Sr. ..... A63H 3/48 446/320
4,662,857 A * 5/1987 Quinn ..... A63H 3/46 446/371
4,669,998 A 6/1987 Amici et al.
4,968,282 A 11/1990 Robson et al.
5,257,873 A 11/1993 Abbat
5,507,678 A * 4/1996 Chiang ..... A63H 3/36 446/369
5,580,295 A 12/1996 Ruzskai et al.
5,620,352 A 4/1997 Tzong
5,628,669 A 5/1997 Hesse
5,897,417 A 4/1999 Grey
5,913,706 A 6/1999 Glickman et al.
5,964,638 A * 10/1999 Emerson ..... A63H 7/00 446/339
6,033,284 A 3/2000 Rodriguez Ferre
6,074,270 A 6/2000 Wilcox et al.
6,086,447 A * 7/2000 Tucker ..... A63H 3/36 446/384
6,110,002 A 8/2000 Langton
6,120,343 A * 9/2000 Migliorati ..... A63H 11/18 446/317
6,328,625 B1 * 12/2001 Lee ..... A63H 3/46 446/376
6,537,130 B1 3/2003 Lee et al.
6,568,984 B1 * 5/2003 Applewhite ..... A63H 30/06 446/176
6,638,136 B1 10/2003 Lee et al.
6,692,332 B2 2/2004 Jheow
6,800,014 B2 * 10/2004 Dominici ..... A63H 3/20 446/320
6,808,437 B2 10/2004 Podd et al.
6,817,921 B2 * 11/2004 Chin ..... A63H 3/46 446/376
7,520,793 B2 4/2009 Pillai et al.
8,308,524 B2 * 11/2012 deFelice ..... A63H 3/20 446/375
2007/0281582 A1 12/2007 Himstedt
2010/0041300 A1 2/2010 Bevirt
2014/0323012 A1 10/2014 Sopinsky et al.
2014/0370777 A1 12/2014 Minassian et al.

* cited by examiner

TOY FIGURES WITH EXPANDABLE ARTICULATING JOINTS

FIELD OF THE INVENTION

This invention relates to toy figures and, more particularly, to toy figures that have expandable articulating joints.

BACKGROUND

Toy figures have long been popular among children and even adults. Toy figures are often poseable and based upon popular characters, such as animated characters and superheroes. The market for toy figures based on popular characters can be significant.

While it is desirable for toy figures to closely resemble the appearance and movements of the characters upon which they are based, the ability to translate these features into a toy figure can be challenging and difficult. This is particularly true for animated characters and superheroes as they are typically characterized as having non-human features or movements.

BRIEF SUMMARY

In one embodiment, an articulating toy figure is provided. The articulating toy figure comprises a body, at least one limb member, and a shaft coupling the at least one limb member to the body. The shaft comprises a first end coupled to the body and a second end coupled to the limb member. The first end may be translationally movable along a first axis between a first position and a second position against a biasing force of a first detent. The first end may be rotationally movable around the first axis. The second end may be coupled to the limb member via a joint configured to permit the limb member to be rotationally movable around a second axis.

In a first aspect, the limb member may be proximal to the body in the first position and the limb member may be distal to the body in the second position.

In a second aspect, the first detent may be a protrusion located along a translational path of the first end when the first end travels between the first position and the second position.

In a third aspect, the second axis may be substantially orthogonal to the first axis.

In a fourth aspect, the first end may be housed within a cavity disposed within the body.

In a fifth aspect, the first end may be a rounded surface in sliding contact with the detent.

In a sixth aspect, the joint may be a ball-and-socket joint.

In a seventh aspect, the articulating figure may further comprise a head and a neck coupling the head to the body. The head may be movably coupled to a first end of the neck between a first position proximal to the body and a second position distal to the body.

In an eighth aspect, one of the head or the neck may comprise a second detent and the other one of the head or the neck may comprise a surface in resilient contact with the second detent.

In another embodiment, an articulating toy figure is provided. The articulating toy figure comprises a first body and one or more body segments coupled to the first body. The one or more body segments may each be independently and translationally movable between a first position proximal to the first body and a second position distal to the first body. The articulating toy figure further comprises one or more detents to secure the position of the one or more body segments in one of the first and second positions. The one or more body segments may each be movable between the first and second positions by applying a force on the one or more body segments that overcomes the biasing force of the one or more detents.

In a first aspect, the first body and the one or more body segments are different body parts selected from the group consisting of: a head, a complete arm, an upper arm, a lower arm, a hand, a complete leg, an upper leg, a lower leg, a foot, a complete torso, an upper torso, a lower torso, and a tail.

In a second aspect, facing surfaces of the one or more body segments and the first body may be in contact with one another in the first position and a space may be provided between the facing surfaces of the one or more body segments and the first body in the second position.

In a third aspect, the one or more body segments may comprise a head and a neck shaft coupling the head to the first body.

In a fourth aspect, a first end of the neck shaft may comprise a rounded surface that is fitted within a socket disposed in the head and the head may be movable relative to the neck shaft. The socket may comprise a detent that engages the first end of the neck shaft.

In a fifth aspect, the first end of the neck shaft may comprise two or more grooved annular surfaces that define the first and second positions.

In a sixth aspect, the one or more body segments may comprise an arm and a shaft coupling the limb to the first body. The shaft may comprise a first end housed within a cavity disposed within the first body and a second end coupled to the limb.

In a seventh aspect, the second end of the shaft may be coupled to the limb via a ring disposed on one of the shaft and the limb and a cylinder may be disposed on the other one of the shaft and the limb. The cylinder may be shaped to be slidably secured within the ring to permit rotation of the limb in a second plane. The first plane may be orthogonal to the second plane.

In a further embodiment, an articulating toy figure is provided. The articulating toy figure comprises a body, at least one limb member and a shaft coupling the at least one limb member to the body. The shaft comprises a first end housed within a cavity of the body and a second end coupled to the limb. The first end of the shaft is translationally movable along a shaft axis between a first position, which positions the at least one limb member proximal to the body, and a second position, which positions the limb member distal to the body.

The first end of the shaft comprises an annular surface that permits rotation of the shaft within the cavity around a shaft axis. The second end is coupled to the at least one limb member by a joint.

The at least one limb member is rotationally movable around both the shaft axis and an axis that is substantially orthogonal to the shaft axis.

A first detent is provided to secure the first end of the shaft in one of the first and second positions, the first detent being provided within the cavity.

A head is coupled to the body by a neck shaft. The neck shaft comprises a first end housed within a socket of the head and a second end coupled to the body. The head is translationally movable along a neck shaft between a first position, which positions the head proximal to the body, and a second position, which positions the head distal to the body.

The socket comprises a second detent to movably secure the first end of the neck shaft in one of a first annular groove and a second annular groove. The head is pivotally moveable around the first end of the neck shaft.

Each one of the at least one limb member and head are movable between the respective first and second positions by applying a force on the head and the at least one limb member that overcomes the biasing force of the first and second detents, respectively.

Other objects, features and advantages of the described preferred embodiments will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

Preferred and non-limiting embodiments of the inventions may be more readily understood by referring to the accompanying drawings in which.

Like numerals refer to like parts throughout the several views of the drawings.

DETAILED DESCRIPTION OF THE EXEMPLARY EMBODIMENTS

Specific, non-limiting embodiments of the present invention will now be described with reference to the drawings. It should be understood that such embodiments are by way of example only and merely illustrative of but a small number of embodiments within the scope of the present invention. Various changes and modifications obvious to one skilled in the art to which the present invention pertains are deemed to be within the spirit, scope and contemplation of the present invention as further defined in the appended claims.

Figure 1A:
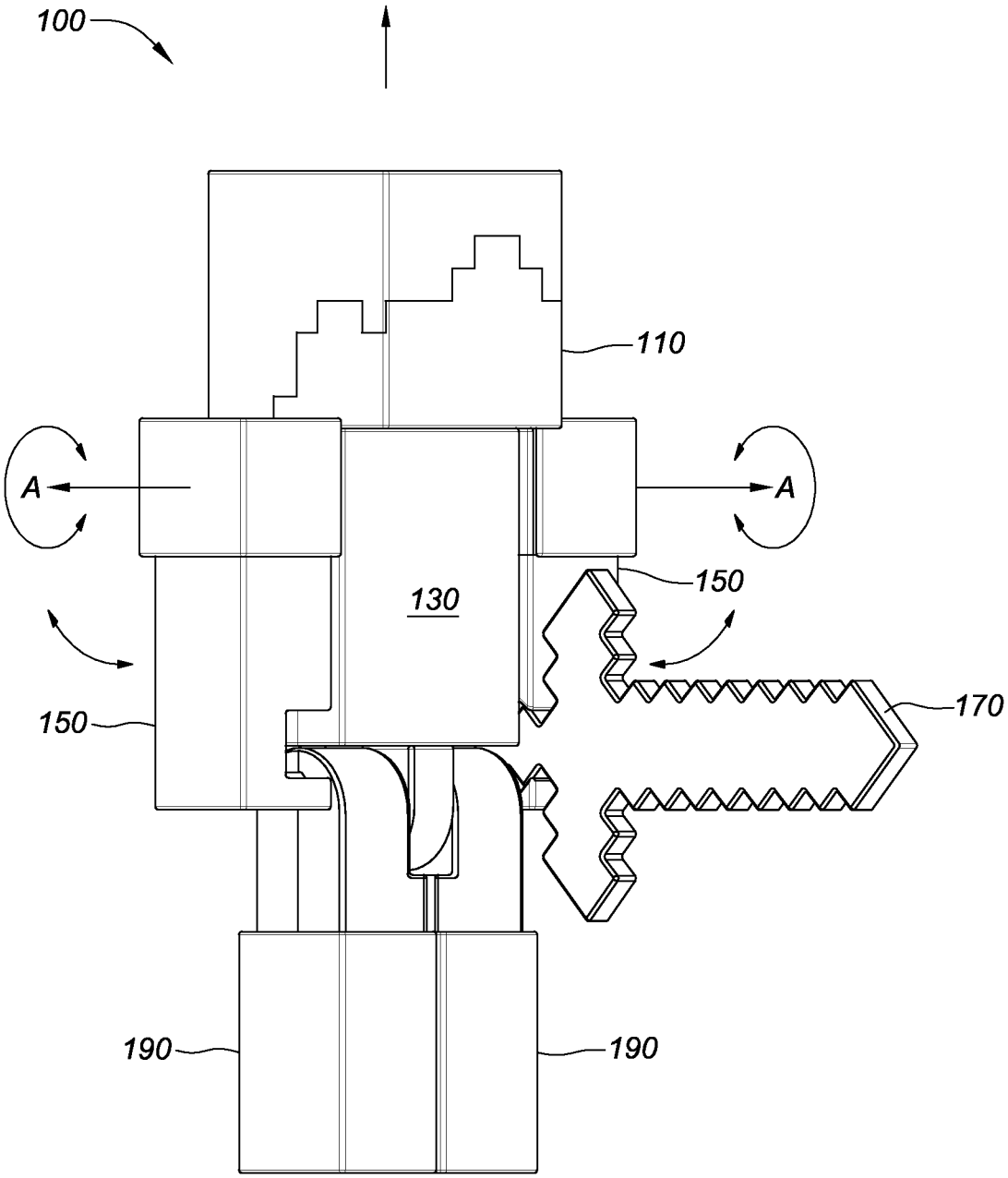
FIG. 1A is a front perspective view of an embodiment of a toy figurine in a contracted configuration.
Figure 1B:
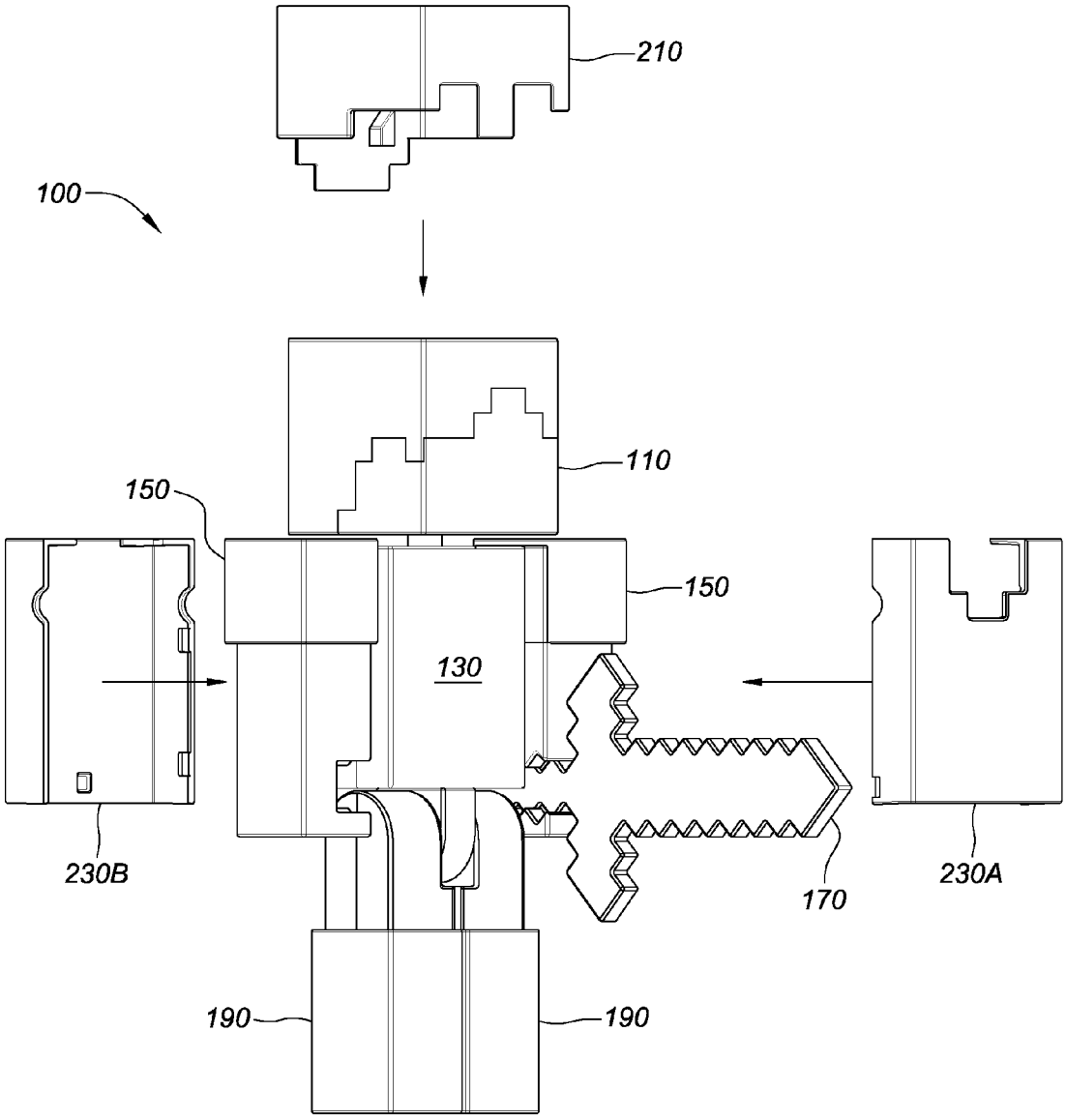
FIG. 1B is a front perspective view of the toy figurine of FIG. 1A in an expanded configuration and depicts the various layers that can be applied to the head and the body.
Figure 1C:
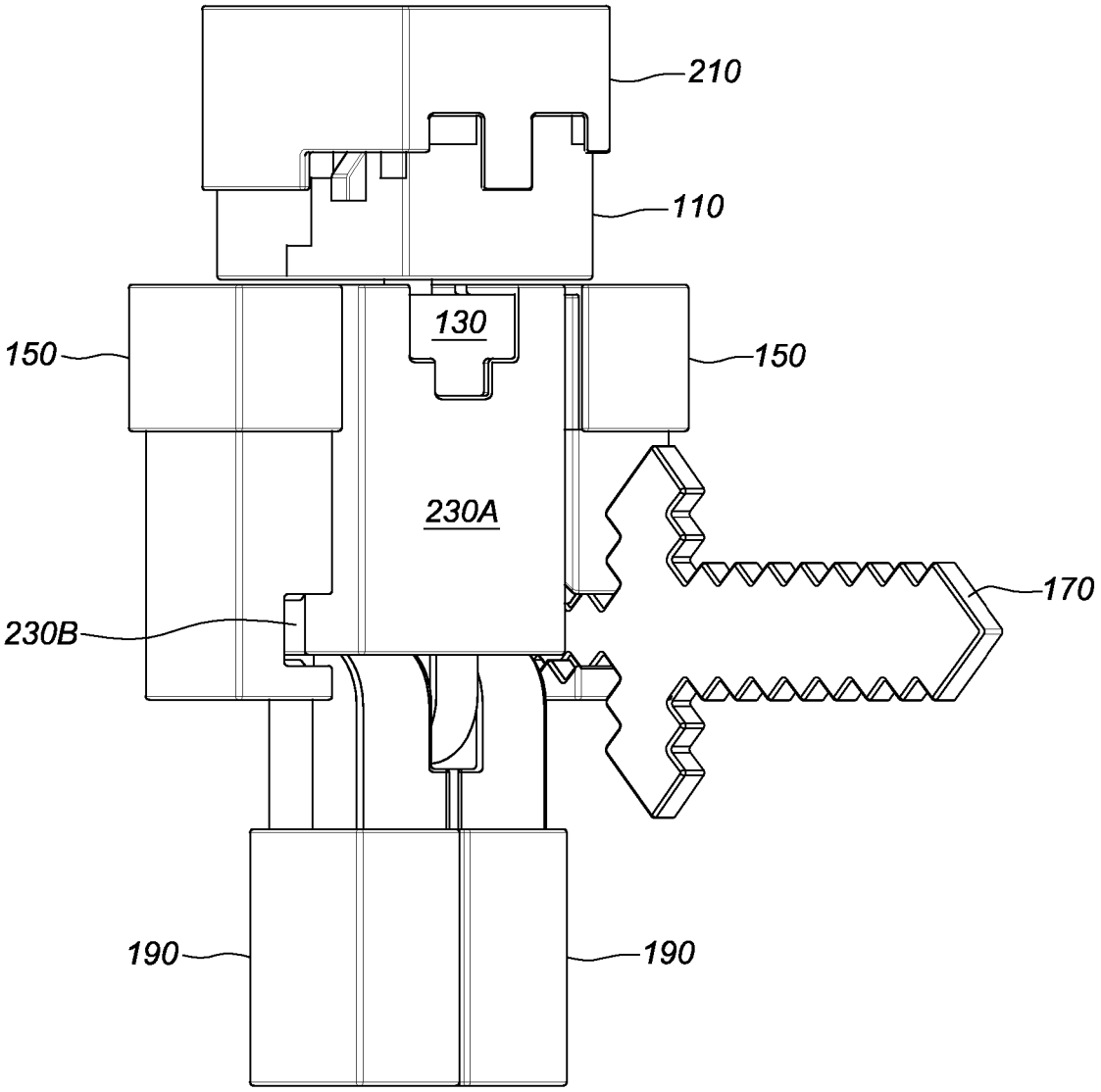
FIG. 1C is a front perspective view of the toy figurine of FIG. 1B in the expanded configuration with the various layers attached to the head and body.

FIGS. 1A-1C depict an embodiment of the articulating toy FIG. 100 as comprising a head 110 coupled to a body or torso 130 and limb members, specifically, arms 150 and legs 190, also coupled to the body 130. The arms 150 are shown shaped with a groove or recess 152 to hold a variety of accessories, such as tools and other implements. In the embodiment depicted in FIGS. 1A-C, the toy FIG. 100 is depicted as carrying a sword 170 that is resiliently and removably coupled to the groove 152. The legs 190 are pivotally attached to the body 130 via a pivot joint.

Figure 2A:
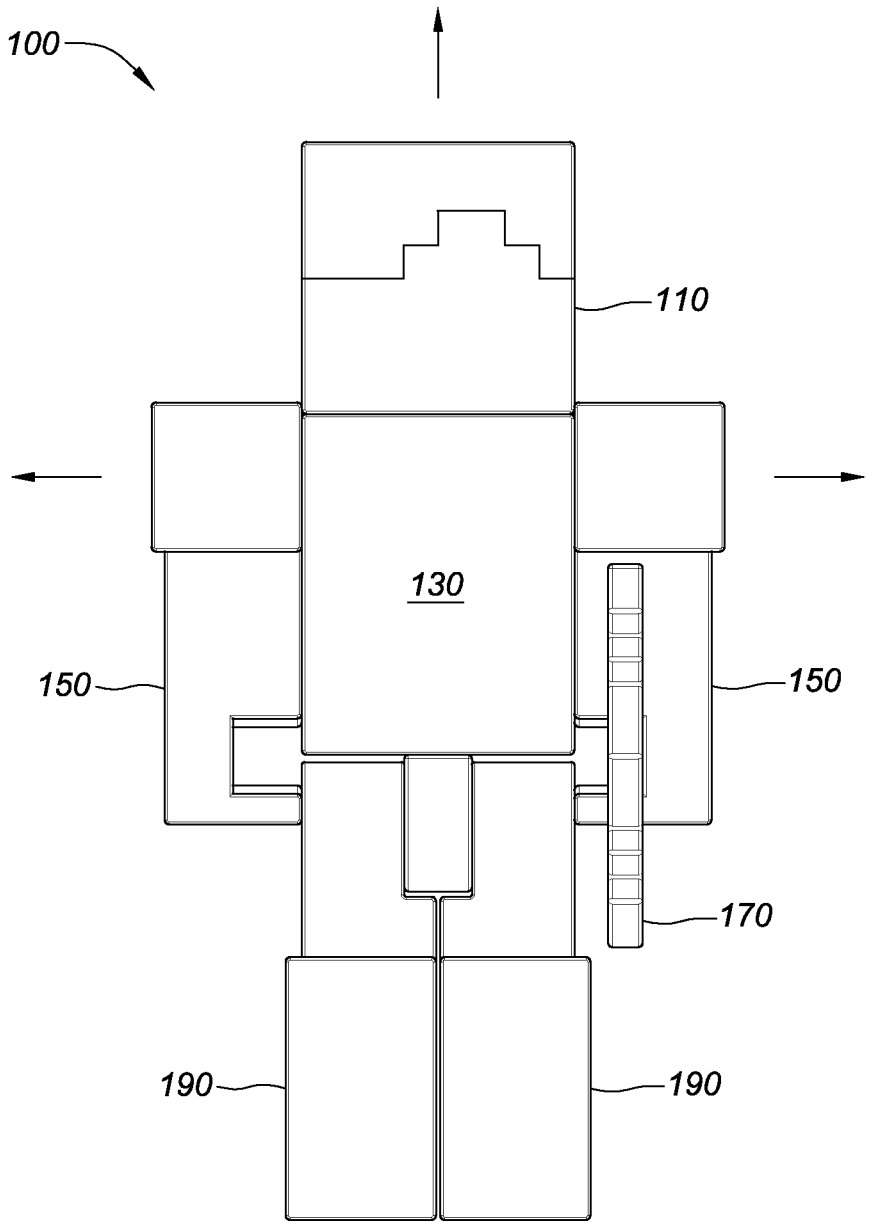
FIG. 2A is a front view of the toy figurine of FIG. 1A in the contracted configuration.

In FIGS. 1A and 2A, the head 110, arms 150 and body 130 are each depicted as having a squared shape such that facing surfaces of the head 110 and the body 130, in the first contracted position, may be positioned in close proximity to one another and, in certain embodiments, in direct physical contact with one another such that those surfaces are "flush" with each other. Similarly, the facing surfaces of the arms 150 and the body 130, in the first contracted position, may be positioned in close proximity to one another and, in certain embodiments, in direct physical contact with one another. The close proximity between facing surfaces of the head 110 and the arms 150, on one hand, and the body 130 on the other hand, make it difficult to apply additional layers onto the body, such as simulated clothing on the toy FIG. 100.

Figure 2B:
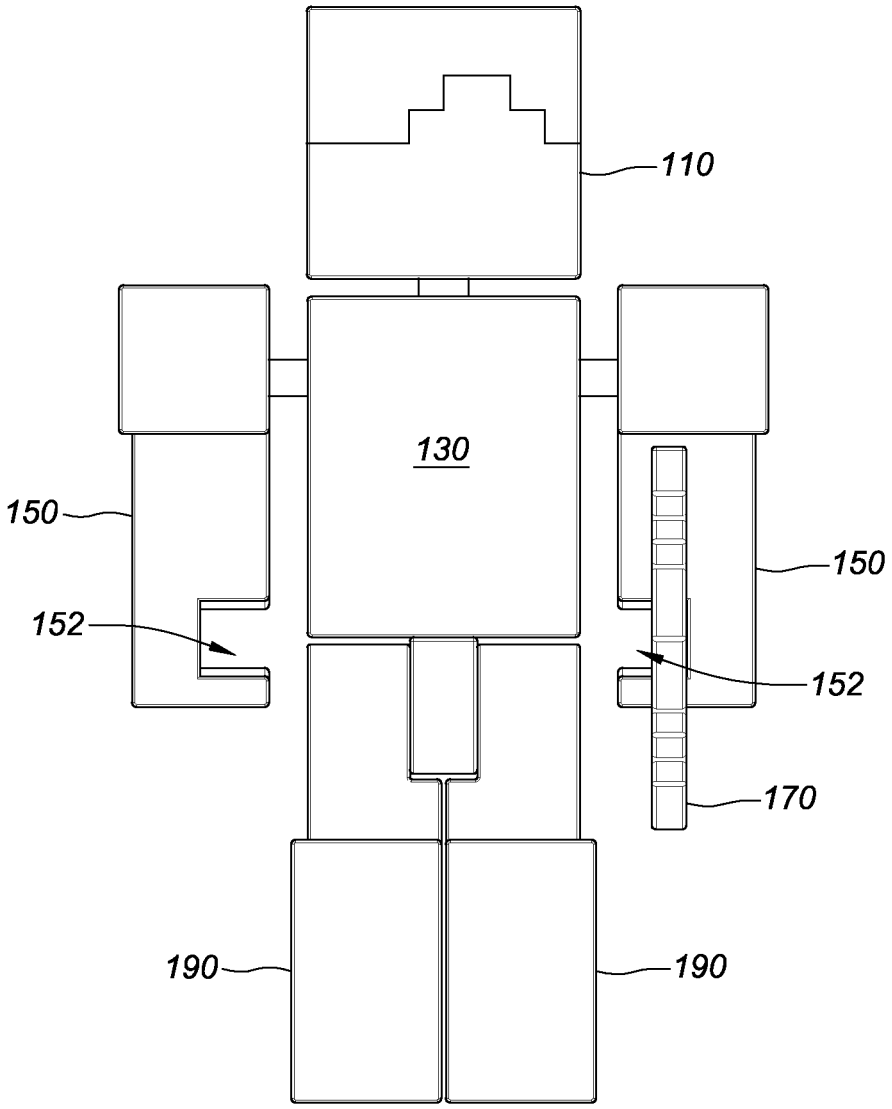
FIG. 2B is a front view of the toy figurine of FIG. 2A in the expanded configuration.
Figure 3A:
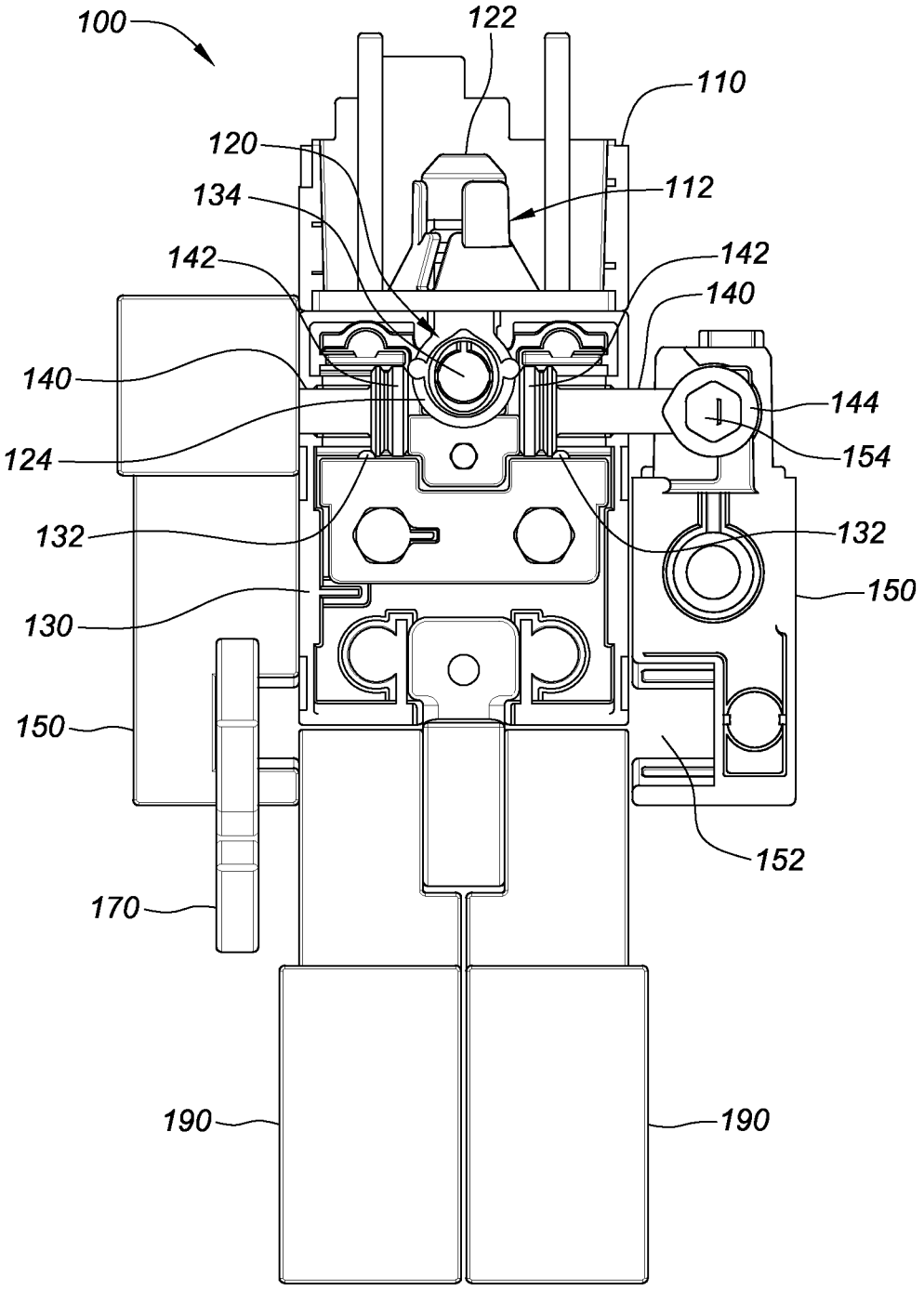
FIG. 3A is a rear view of the toy figurine of FIG. 1A in the contracted configuration, with portions of the head, back and arm cutaway to expose the internal features.

Thus, any combination of the head 110 and each of the arms 150 may be actuated relative to the body 130 between a first contracted position (as shown in FIGS. 1A, 2A and 3A) and a second expanded position (as shown in FIGS. 1B, 1C, 2B, and 3B). As shown in FIG. 1A the head 110 may be actuated away from the body 130 in the direction of the adjacent arrow and each of the arms 150 may be individually actuated away from the body along a first axis A-A.

FIGS. 1B and 2B depict the toy FIG. 100 with each of the head 110 and arms 150 in the second expanded position to provide a space between facing surfaces of the head 110 and arms 150, on the one hand, and the body 130, on the other hand. Having the toy FIG. 100 in this configuration permits the application of an additional layer 230A, 230B to the body 130. The additional layer 230A, 230B, as depicted in FIG. 1B, is shaped to fit around the torso 130 and may include additional features, such as sculpting, chip art, paint, or other markings to reference a shirt, body armor, or other article of clothing. The additional layer 230A, 230B may be resiliently and removably attached to the body 130 without interfering with the articulation of the head 110 and the arms 150. In the depicted embodiment, a removable hat or helmet 210 is provided to fit on the head 110 of the toy FIG. 100. FIG. 1C depicts the toy FIG. 100 with the hat 210 and the shirt 230A, 230B assembled onto the head 110 and body 130, respectively.

Figure 3B:
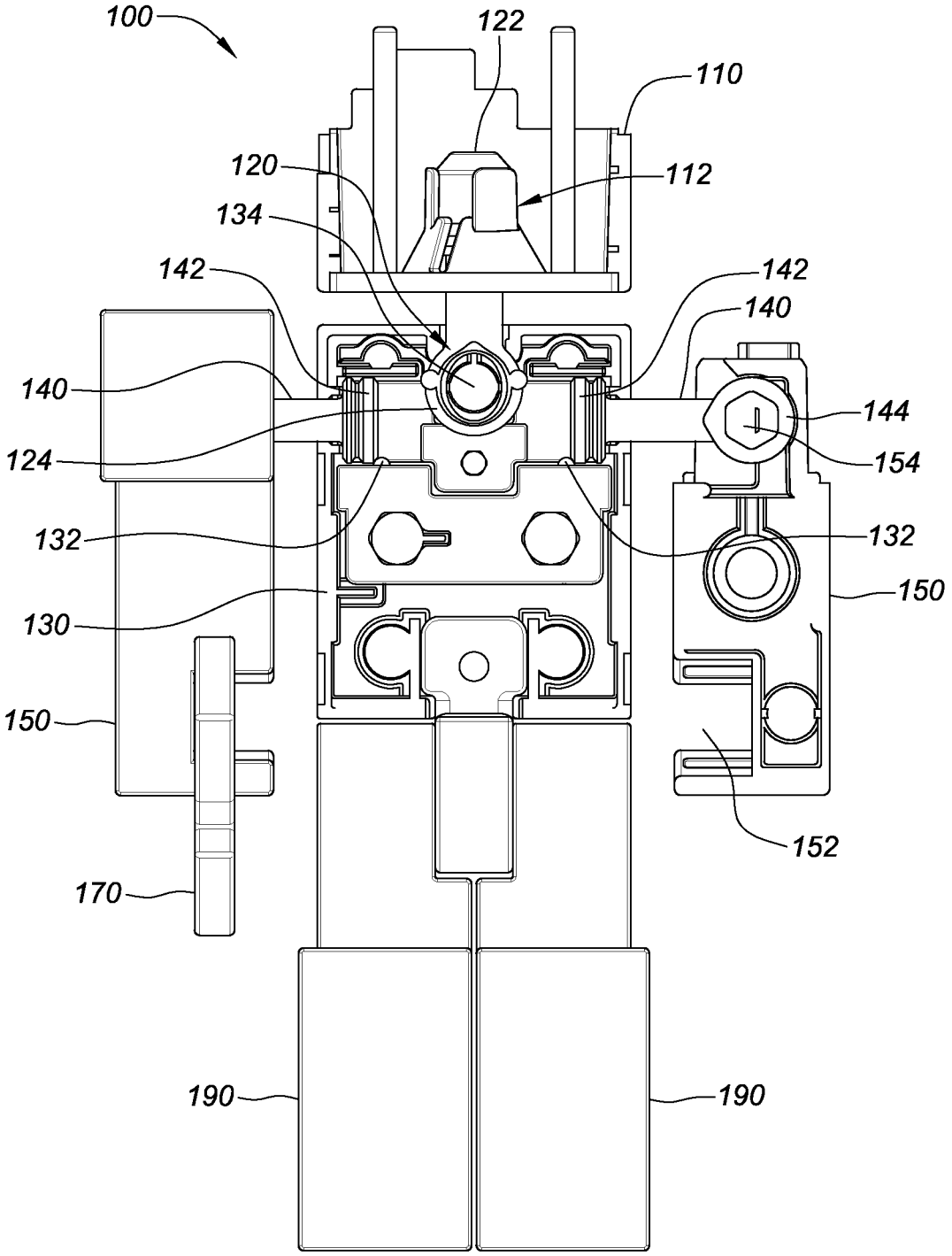
FIG. 3B is a rear view of the toy figurine of FIG. 3A in the expanded configuration.

FIGS. 3A and 3B depict the internal features of the toy figurine 100 as the head 110 and arms 150 are each actuated between the first contracted configuration (FIG. 3A) and the second expanded configuration (FIG. 3B). As shown in these figures, the arms 150 are each coupled to the body 130 by a shaft 140.

The shaft 140 comprises a first end 142 slidably disposed within a cavity defined in the body 130 along a first axis A-A (see FIG. 1A). The shaft 140 permits the arm 150 to move both translationally along the A-A axis (to position the arm 150 proximal or distal to the body 130) and rotatably around the A-A axis.

The first end 142 is translationally movable along the first axis A-A across the length of the cavity disposed within the body. A detent 132 is provided to demarcate the first and second position of the first end 142 within the cavity, which, in turn, positions the arm 150 proximal and distal to the body 130, respectively. FIG. 3A depicts the first end 142 of the shaft 140 in a first position in which the first end 142 is located proximal to the center line of the body 130. FIG. 3B depicts the first end 142 of the shaft in a second position in which the first end 142 is located distal to the center line of the body 130.

The first end 142 may be articulated between the first and second positions against the biasing force of the detent 132, which may be a resilient protrusion or spring. The first end 142 may have an annular external surface that fits within a correspondingly shaped and sized cavity. The annular external surface permits the arm 150 to rotate around the first axis A-A. In one embodiment, the arm 150 can freely rotate around the first axis A-A.

The shaft 140 also comprises a second end 144 which cooperates with a feature on the limb 154 to define a pivot joint. In one embodiment, the second end 144 of the shaft 140 may be a ring that is slidably fitted onto a corresponding cylindrical protrusion 154 disposed within the arm 150 such that it permits the arm 150 to pivot around a second axis that is substantially orthogonal to the first axis A-A. Thus, the annular surface of the first end 142 slidably disposed within the body cavity and the pivot joint at the second end 144 with the limb feature 154 permit the limb 150 to rotate in two different planes.

Now, with reference to FIGS. 3A, 3B, 4, 5A and 5B, the actuation of the head 110 will be described. FIGS. 3A and 3B depict the head 110 as being coupled to the body 130 via a neck shaft 120. The neck shaft 120 comprises a first end 122 that is housed within a socket 112 disposed within the head 110 and a second end 124 that is coupled to the body 130.

Figure 4:
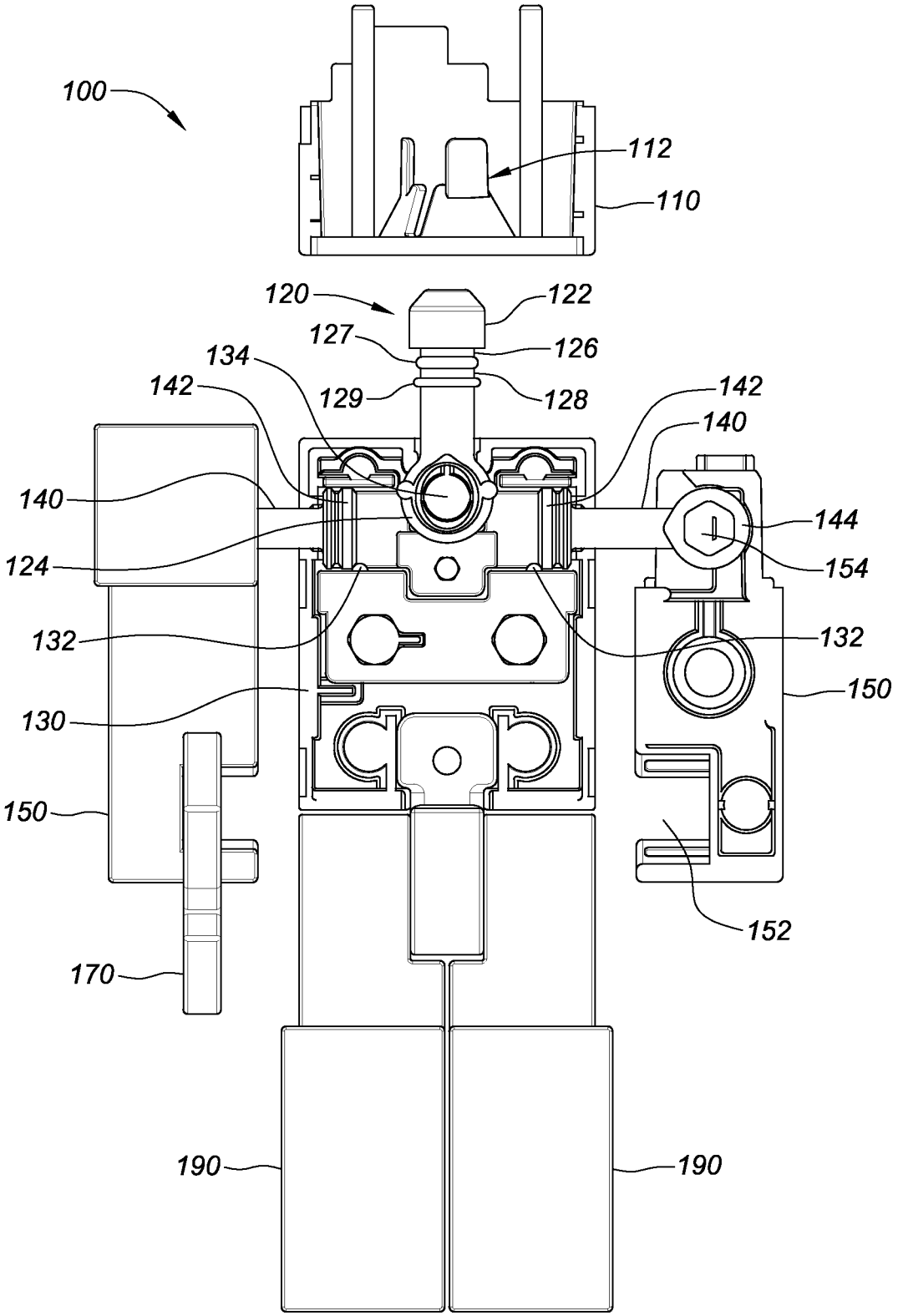
FIG. 4 is an exploded rear view of the toy figurine of FIG. 3B showing the features of the neck shaft.

As depicted in FIG. 4, the first end 122 of the neck shaft comprises a rounded tip and a narrowed shaft portion comprising a pair of annular grooves 126 and 128. The first annular groove 128 is disposed between the first ring 127 and the second ring 129 and the second annular groove 126 is disposed between the rounded tip and the first ring 127. One of the annular groove 126 and 128 engages a second detent 118 disposed within the socket 112 of the head 110 (see FIGS. 5A and 5B). When the second detent 118 of the head socket 110 is positioned within the first annular groove 128 of the neck shaft 120, the head 110 is in the first position, as depicted in FIG. 3A, and when the second detent 118 of the head socket 110 is positioned within the second annular groove 126, the head 110 is in the second position, as depicted in FIG. 3B.

Figure 5A:
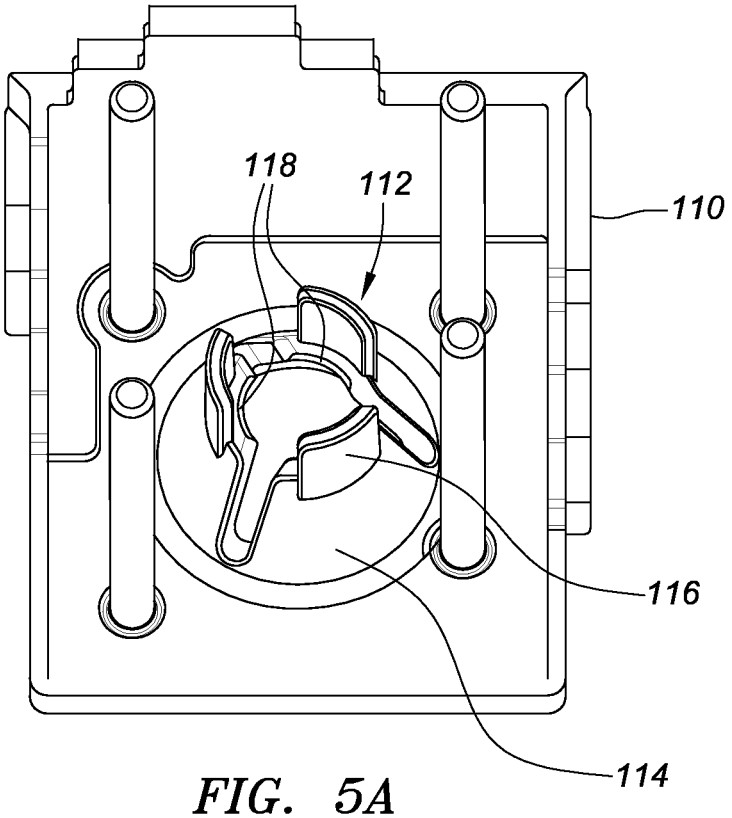
FIG. 5A is a rear perspective top view of the head with the top portion cutaway to reveal the head socket.
Figure 5B:
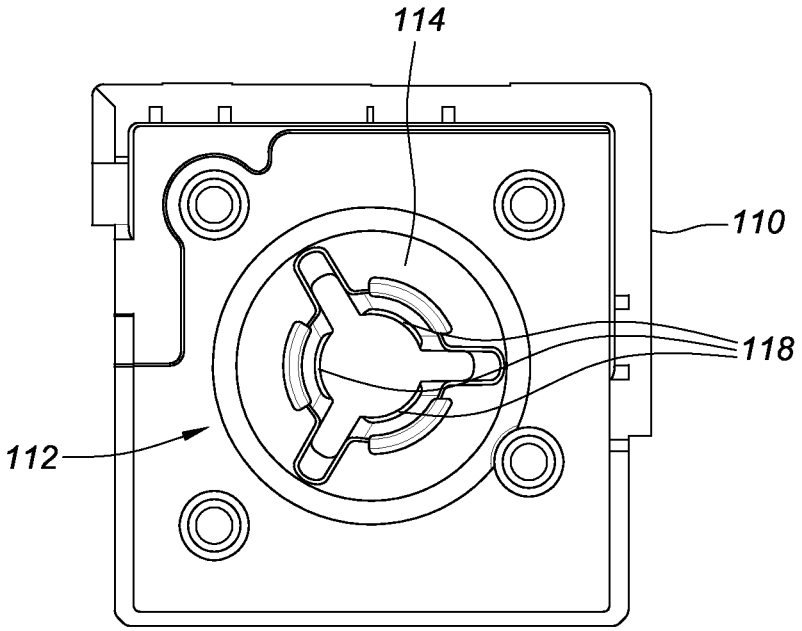
FIG. 5B is a top plan view of the head with the top portion cutaway to reveal the circumferential detent in the head socket.

FIGS. 5A and 5B depict the features of the socket 112 that receives the first end 122 of the neck shaft 120. The socket 112 generally defines a wide conical section 114 to the head that narrows to a plurality of cylindrical flanges 116. The second detent 118 is provided as extending inwardly from the internal annular surface of the conical section 114. In one preferred embodiment, the conical section 114 may be divided into a plurality of spaced segments, in FIGS. 5A and 5B, into three spaced segments. This permits the detents 118 be moved apart from one another as the head 110 is moved between the first and second positions and the first ring 127 urges the detents 118 outwardly. Each one of the conical sections 114 is resiliently biased toward the neck shaft 120 and thus the detents 118 resiliently springs into one of the first and second annular grooves 128, 127 as it clears the first ring 127. The annular surface of the first and second grooves 126, 128 also permits the head to rotate about the axis of the neck shaft 122.

The neck shaft 120 also comprises a second end 124 that is coupled to a corresponding feature 134 within the cavity of the body 130. The coupling of the second end 124 and the feature 134 may form a fixed joint, a ball-and-socket joint or a pivot joint. In the embodiment depicted in FIGS. 3A and 3B, the second end 124 rotates around the feature 134 and, unlike the first end 142, is not translationally movable relative to the arm 150.

It is to be understood that the detailed description and specific examples, while indicating preferred embodiments of the present disclosure, are given by way of illustration and not limitation. Many changes and modifications within the scope of the present disclosure may be made without departing from the spirit thereof, and the disclosure includes all such modifications.

In the embodiments disclosed herein, the joint systems have been described as providing at least the ability (1) to translationally move one or more body segments between a first proximal position and a second distal position relative to the body to which it is coupled and (2) to rotate the one or more body segments freely around the translational axis. While the joint systems have been specifically described for the head and arms of a toy figure, it is understood that the joint systems can also be utilized to connect any two parts for which such movements are desired.

For example, similar joint systems may be utilized at any traditional joint for a toy figure. In some embodiments, the above described joints may connect an upper arm to a lower arm (i.e. at an "elbow" joint), an upper leg to a lower leg (i.e. at a "knee" joint), an upper thigh to a lower torso (i.e. at a "hip" joint), an upper torso to a lower torso (i.e. at a "waist" joint), a lower arm to a hand (i.e. at a "wrist" joint), a lower leg to a foot (i.e. at an "ankle" joint), etc. These various embodiments may accommodate the attachment of various articles, such as "shirts" with various length "sleeves" and "pants" of various lengths, to the toy figure.

The invention claimed is:

1. An articulating toy figure comprising:
a body;
at least one limb member;
a shaft coupling the at least one limb member to the body,
the shaft comprising a first end coupled to the body and a second end coupled to the limb member,
the first end being translationally movable along a first axis between a first position and a second position against a biasing force of a first detent;
the first end being rotationally movable around the first axis; and
the second end being coupled to the limb member via a joint configured to permit the limb member to be rotationally movable around a second axis.

2. The articulating toy figure of claim 1, wherein in the first position, the limb member is proximal to the body and wherein in the second position, the limb member is distal to the body.

3. The articulating toy figure of claim 1, wherein the first detent is a protrusion located along a translational path of the first end when the first end travels between the first position and the second position.

4. The articulating toy figure of claim 1, wherein the second axis is substantially orthogonal to the first axis.

5. The articulating toy figure of claim 1, wherein the first end is housed within a cavity disposed within the body.

6. The articulating toy figure of claim 5, wherein the first end comprises a rounded surface in sliding contact with the detent.

7. The articulating toy figure of claim 1, wherein the joint is a ball-and-socket joint.

8. The articulating toy figure of claim 1, further comprising a head and a neck coupling the head to the body, the head being movably coupled to a first end of the neck between a first position proximal to the body and a second position distal to the body.

9. The articulating toy figure of claim 8, wherein one of the head or the neck comprises a second detent and the other one of the head or the neck comprises a surface in resilient contact with the second detent.

10. An articulating toy figure comprising:

a first body segment;

one or more body segments coupled to the first body segment, wherein the one or more body segments are each independently and translationally movable between a first position proximal to the body and a second position distal to the body; and one or more detents to secure the position of the one or more body segments in one of the first and second positions;

wherein the one or more body segments are each movable between the first and second positions by applying a force on the one or more body segments that overcomes the biasing force of the one or more detents;

wherein the one or more body segments comprise a limb and a shaft coupling the limb to the first body segment, the shaft comprising a first end housed within a cavity disposed within the first body and a second end coupled to the limb;

wherein the second end is coupled to the limb via a ring disposed on one of the shaft and the limb and a cylinder disposed on the other one of the shaft and the limb, the cylinder being shaped to be slidably secured within the ring to permit rotation of the limb in a second plane.

11. The articulating toy figure of claim 10, wherein in the first position, facing surfaces of the one or more body segments and the first body are in contact with one another and wherein in the second position, a space is provided between the facing surfaces of the one or more body segments and the first body.

12. The articulating toy figure of claim 10, wherein the one or more body segments comprise a head and a neck shaft coupling the head to the first body.

13. The articulating toy figure of claim 12, wherein a first end of the neck shaft comprises a rounded surface that is fitted within a socket disposed in the head and wherein the head is movable relative to the neck shaft.

14. The articulating toy figure of claim 13, wherein the socket comprises a detent that engages the first end of the neck shaft.

15. The articulating toy figure of claim 14, wherein the first end comprises two or more grooved annular surfaces that define the first and second positions.

16. The articulating toy of claim 10, wherein the first plane is orthogonal to the second plane.

17. An articulating toy figure comprising:

a body;

at least one limb member and a shaft coupling the at least one limb member to the body, the shaft comprising a first end housed within a cavity of the body and a second end coupled to the limb;

wherein the first end of the shaft is translationally movable along a shaft axis between a first position, which positions the at least one limb member proximal to the body, and a second position, which positions the at least one limb member distal to the body;

wherein the first end comprises an annular surface that permits rotation of the shaft within the cavity around a shaft axis;

wherein the second end is coupled to the at least one limb member by a joint;

wherein the at least one limb member is rotationally movable around both the shaft axis and an axis that is substantially orthogonal to the shaft axis;

a first detent to secure the first end of the shaft in one of the first and second positions, the first detent being provided within the cavity; and a head and a neck shaft coupling the head to the body, the neck shaft comprising a first end housed within a socket of the head and a second end coupled to the body;

wherein the head is translationally movable along a neck shaft between a first position, which positions the head proximal to the body, and a second position, which positions the head distal to the body;

wherein the socket comprises a second detent to movably secure the first end of the neck shaft in one of a first annular groove and a second annular groove;

wherein the head is pivotally moveable around the first end of the neck shaft; and wherein each one of the at least one limb member and head are movable between the respective first and second positions by applying a force on the head and the at least one limb member that overcomes the biasing force of the first and second detents, respectively.

* * * * *